US012480056B2

(12) United States Patent
Dixit et al.

(10) Patent No.: US 12,480,056 B2
(45) Date of Patent: Nov. 25, 2025

(54) PROCESS FOR PRODUCTION OF NEEDLE COKE AND AROMATICS

(71) Applicant: Indian Oil Corporation Limited, Mumbai (IN)

(72) Inventors: Shivam Ashok Dixit, Faridabad (IN); Ponoly Ramachandran Pradeep, Faridabad (IN); Mainak Sarkar, Faridabad (IN); Satyen Kumar Das, Faridabad (IN); Madhusudan Sau, Faridabad (IN); Sankara Sri Venkata Ramakumar, Faridabad (IN)

(73) Assignee: Indian Oil Corporation Limited (IN)

( * ) Notice: Subject to any disclaimer, the term of this patent is extended or adjusted under 35 U.S.C. 154(b) by 174 days.

(21) Appl. No.: 18/530,039

(22) Filed: Dec. 5, 2023

(65) Prior Publication Data

US 2024/0182787 A1 Jun. 6, 2024

(30) Foreign Application Priority Data

Dec. 5, 2022 (IN) ..... 202221070151

(51) Int. Cl.

| | |
|---|---|
| ***C10B 55/00*** | (2006.01) |
| ***C10B 57/02*** | (2006.01) |
| ***C10G 67/16*** | (2006.01) |

(52) U.S. Cl.

CPC ..... *C10B 55/00* (2013.01); *C10B 57/02* (2013.01); *C10G 67/16* (2013.01); *C10G 2300/1096* (2013.01); *C10G 2300/201* (2013.01); *C10G 2300/4006* (2013.01); *C10G 2300/4012* (2013.01); *C10G 2300/4037* (2013.01); *C10G 2300/4081* (2013.01); *C10G 2300/708* (2013.01); *C10G 2400/30* (2013.01)

(58) Field of Classification Search

CPC ..... C10B 55/00; C10B 57/02; C10B 57/045; C10G 67/16; C10G 2300/1096; C10G 2300/201; C10G 2300/4006; C10G 2300/4012; C10G 2300/4037; C10G 2300/4081; C10G 2300/708; C10G 2400/30; C10G 51/023; C10G 55/04; C10G 55/06; C10G 69/14

See application file for complete search history.

(56) References Cited

U.S. PATENT DOCUMENTS

| | | | |
|---|---|---|---|
| 4,177,133 | A | 12/1979 | Hase et al. |
| 4,466,883 | A | 8/1984 | Eickemeyer et al. |
| 4,547,284 | A | 10/1985 | Sze et al. |
| 5,286,371 | A | 2/1994 | Goval et al. |

(Continued)

FOREIGN PATENT DOCUMENTS

| | | | |
|---|---|---|---|
| CN | 101302443 | A | 11/2008 |
| CN | 103102978 | A | 5/2013 |

*Primary Examiner* — Randy Boyer
*Assistant Examiner* — Juan C Valencia

(57) ABSTRACT

The present disclosure provides a process for preparing a needle coke or a crystalline coke from aromatic rich hydrocarbon streams. The process includes preparing a needle coke or a crystalline coke from Pyrolytic Fuel Oil (PFO) and Clarified Oil (CLO) stream along with Purified fraction of CLO after solvent separation of refractory asphaltene compounds while the low boiling fractions separated from PFO and light gasoil (LGO) from the thermal cracking section are selectively hydro cracked to produce high value aromatic chemicals.

12 Claims, 1 Drawing Sheet

(56) References Cited

U.S. PATENT DOCUMENTS

| | | | | |
|---|---|---|---|---|
| 7,604,731 | B2 | 10/2009 | Bhattacharyya et al. | |
| 10,125,318 | B2 | 11/2018 | Koseoglu | |
| 2022/0041935 | A1* | 2/2022 | Mondal | B01D 11/0488 |
| 2023/0332055 | A1* | 10/2023 | Park | C10G 1/02 |

* cited by examiner

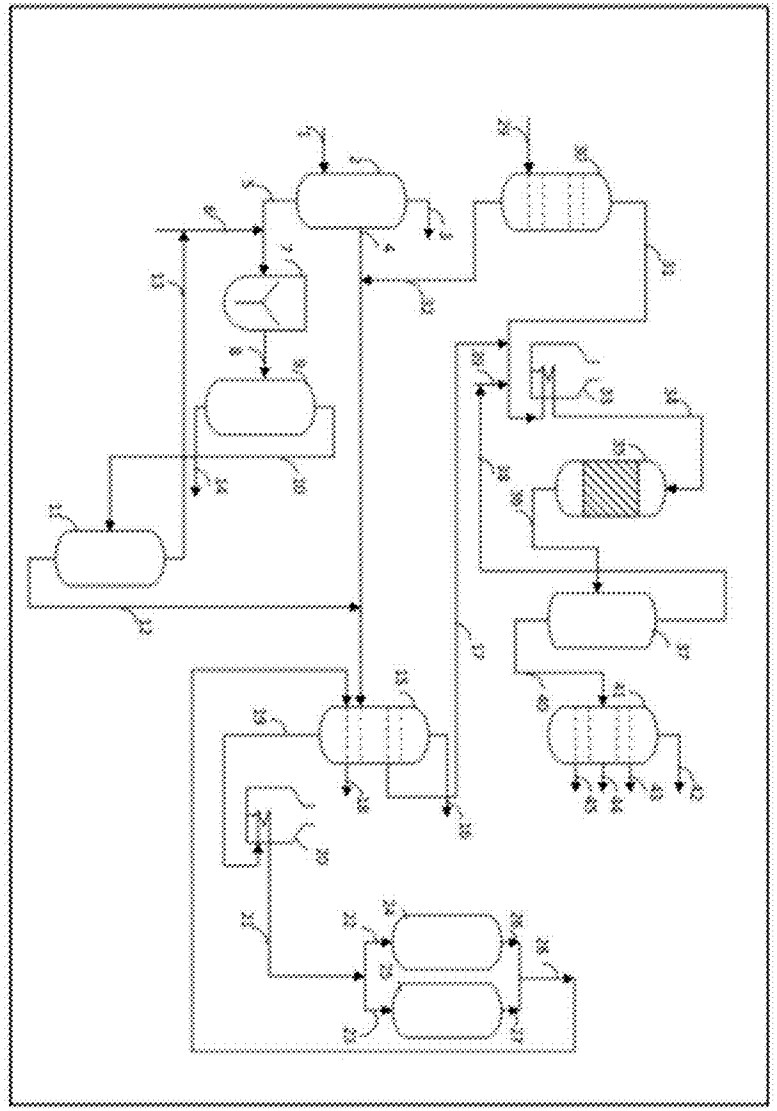

PROCESS FOR PRODUCTION OF NEEDLE COKE AND AROMATICS

CROSS-REFERENCE TO RELATED APPLICATIONS

This application claims the benefit of priority of Indian Patent Application No. 202221070151 filed on Dec. 5, 2022, in the Indian Patent Office, the disclosure of which is incorporated herein by reference in its entirety.

FIELD

The present disclosure relates to a process for production of Needle coke from Pyrolytic Fuel Oil (PFO) and Clarified Oil (CLO). Specifically, the present disclosure relates to a process for production of improved quality Needle coke or crystalline coke as well as value added chemicals by employing stream separation, solvent separation of refractory asphaltene compounds, thermal cracking and selective hydrocracking sections.

BACKGROUND

Needle coke is a high value coke product obtained from thermal cracking process such as delayed coking and is used for production of graphite electrodes. In addition to crystallinity, quality of Needle coke is also governed by parameters such as Ash, Sulfur etc. and it is essential to ensure that such parameters are within specified limits. Different techniques are employed to obtain desired quality Needle coke and prior known methods disclose production of needle coke from petroleum feed stock.

U.S. Pat. No. 4,177,133 discloses a process for producing high crystalline petroleum coke from petroleum feed stock by subjecting the feed stock to preheat treatment followed by flash distillation to remove non-crystalline substances as pitch, fractionating the distillate and subjecting the heavy residue thus obtained to delayed coking to produce crystalline coke.

U.S. Pat. No. 5,286,371 discloses a process for producing Needle coke comprising the steps of passing a heavy resid feed stock to resid hydrotreating to produce light and heavy resid hydrotreated products. The heavy resid hydrotreated product and FCC decant oil is subjected to solvent extraction to produce products comprising a solvent extracted oil and resin stream and a stream comprising asphaltenes.

At least one portion of the solvent extracted oil and resin stream is subjected to Delayed Coking to produce liquid products and premium grade coke.

U.S. Pat. No. 4,547,284A discloses a process for producing needle coke from a coking feedstock, comprising: heat soaking the feedstock at a temperature of from 230° C. to 315° C. to polymerize unsaturates; heating the heat-soaked feedstock to effect thermal cracking thereof at a final temperature of from 450° C. to 595° C.; separating non-crystalline substances and heavy components to produce a pitch free feed; heating pitch free feed in a coking heater and introducing the heated pitch free feed into a coking drum operated at a temperature of from 415° C. to 455° C, taking the coke drum off-stream after filling thereof to a desired level by discontinuing introduction of the pitch free feed; and heating the contents of the off-stream coke drum at a temperature which is at least 10° C. greater than the prior coking temperature and which is from 450° C. to 500° C., said heating being effected for a time sufficient to provide a coke having a volatile combustible matter content of at least 4% and no greater than 10%, all by weight. It further discloses that feedstock containing at least one member selected from the group consisting of pyrolysis fuel oils, lube oil extracts, hydrodesulfurized lube oil extracts, catalytic cracker decant oils and thermally cracked tars.

U.S. Pat. No. 7,604,731B2 discloses a process for producing needle coke from heavy atmospheric distillation residues having sulfur no more than 0.7 wt %. The process involves the steps of heating the feedstock to a temperature in the range of 440 to 520° C. for thermal cracking in a soaking column under pressure in the range of 1 to 10 $kg/cm^2$ to separate the easily cokable material, separating the cracked products in a quench column and a distillation column and then subjecting the hydrocarbon fraction from the bottom of the quench column and a hydrocarbon fraction having a boiling point in the range of 380 to 480° C. from the distillation column and/or any other suitable heavier hydrocarbon streams in a definite ratio depending on certain characteristic parameters to thermal cracking in a second soaking column at a temperature of 460 to 540° C., pressure in the range of 2 to 20 $kg/cm^2$ in presence of added quantity of steam for formation of a mesophase carbonaceous structure which on steam stripping and cooling forms a solid crystalline coke suitable for manufacturing of graphite electrode of large diameter having co-efficient of thermal expansion lower than $1.1\times10^{-6}$/° C. measured on graphite artifact in the temperature range of 25 to 525° C.

U.S. Ser. No. 10/125,318B2 discloses process embodiments for producing green coke from residual oil comprise introducing residual oil and a solvent mixture into a mixing vessel to produce a feed mixture, the solvent mixture comprising at least one paraffinic solvent with a carbon number from 3 to 8 and at least one aromatic solvent, where the solvent mixture comprises from 0.1 to 10% by volume of aromatic solvent and 90 to 99.9% by volume of paraffinic solvent, passing the feed mixture to a solvent deasphalting unit to produce a deasphalted oil (DAO) fraction and an asphalt fraction, and passing the DAO fraction to a delayed coker to produce the green coke and a delayed coker effluent.

U.S. Pat. No. 4,466,883 discloses a process for production of an improved grade of needle coke employing selected proportions of pyrolysis furnace oil along with a hydrodesulfurized blend of clarified oil and lubricating oil extract. Thereafter, the feed stock is subjected to heat soaking in presence of sulfur, thermal cracking and flash separation to remove pitch as a residue to obtain a pitch free overhead stream. Thereafter, the cokable pitch free stream is subjected to Delayed coking to produce needle coke.

CN101302443A discloses a technique for producing Needle coke and light oil products. It comprises of a thermal pre-treatment of oils such as virgin wax oil, coked wax oil, dense oil, atmospheric and vacuum residue, ethylene char oil etc. in a Visbreaker Unit to obtain fraction boiling below 360° C. and heavy gasoil fraction in the boiling range of 360-540° C. Heavy gas oil so obtained is processed in a Delayed Coker Unit to produce Needle coke while the light oil fraction is further separated into gasoline and diesel.

CN103102978A discloses a method for fractionating ethylene tar into light and heavy fractions. Heavy fraction so obtained is mixed with a conventional coking raw material and processed in a Delayed Coker Unit to obtain light products such as coker gasoline, coker diesel oil, coker gas oil. The gasoline and diesel so obtained are mixed with lighter fraction of ethylene tar and processed in a hydrofining unit to obtain gasoline-I. Thereafter, product heavier than gasoline-I is mixed with Coker gas oil and subjected to hydrotreating/hydrocracking to obtain gasoline-II and diesel. Gasoline-I and II are mixed to generate gasoline fraction.

The above disclosed prior known methods describe production of needle/crystalline coke, however, the process as disclosed in above known prior arts have drawbacks such as, low yield of the needle coke, production of many low value by-products and/or no reutilization of these byproducts etc. and none of the prior arts describe any integrated process for production of Needle coke with low ash content along with production of aromatic chemicals.

For example, U.S. Pat. No. 4,177,133 discloses a method for production of improved quality needle coke by removal of non-crystalline substances from feed stock. It does not describe any technique for recovery of Purified CLO fraction from the rejected residue stream which may be utilized for Needle coke production. U.S. Pat. No. 5,286,371 teaches hydro treatment of residue stream followed by solvent extraction. However, hydrotreatment of heavy residues may not be cost effective due to high hydrogen requirement. Also, hydrotreatment of feed stock for Needle coke production may lead to saturation of aromatic molecules which may result in loss of Needle coke quality and yield. U.S. Pat. No. 4,466,883 describes production of needle coke from hydrotreated CLO and lube oil extract and Pyrolysis Fuel Oil involving a heat soaking step where sulfur is added to improve the flow behavior in the transfer line. However, the current invention does not describe the hydrotreatment of heavy residue stream resulting into high hydrogen requirement. In this invention, a tailor-made feed blend comprising of aromatics specific to Needle coke production is prepared from PFO and CLO and converted to Needle coke while impurities are rejected in the form of Heavy Residue while lighter molecules derived from PFO and CLO are utilized for production of aromatic chemicals. In a way, this invention makes use of molecular management approach for production of high value products. CN 101302443A describes a process for production of Needle coke and light oil products by employing mild thermal cracking of residue streams wherein the heavier oils separated from Visbroken effluent are subjected Delayed Coking to produce Needle coke. However, the current invention does not deploy mild thermal cracking step for production of heavy oils. Also, the prior art does not discuss any method for reducing the ash content of Needle coke and improving its quality along with production of chemicals.

Similarly, CN103102978 A describes a method for separation of lighter and heavier fractions from Ethylene tar wherein the heavier fraction is mixed with conventional feed stock for Delayed Coker Unit (DCU) and processed in the same. However, it may be difficult to produce Needle coke with conventional DCU feed stock owing to presence of asphaltenes, sulfur, metals etc. while Needle coke production requires a tailor made feed. Further, in the prior art, the lighter oils are subjected to hydrotreatment to obtain value added fuels such as gasoline and diesel and not utilized for production of aromatic chemicals. Thus, this prior art does not describe any process for production of improved quality Needle coke and chemicals.

Accordingly, there is a need for an integrated process for production of improved quality Needle Coke and aromatic chemicals from residue streams such as PFO and CLO.

TECHNICAL ADVANTAGES

The process as disclosed herein produces needle coke from residual streams such as CLO and PFO, wherein, the produced needle coke has lesser impurities such as ash content which is a crucial parameter for determining the quality of the Needle coke. Crystallinity of coke is improved in the process by separating a 'heart cut' stream from CLO and/or mixing with a part of PFO. The Heavy Residue stream (preferable boiling range heavier than 500° C.) obtained after separating the lighter fraction (preferable boiling range less than 350° C.) and heart cut (preferable boiling range 350-500° C.), is subjected to purification to reject the impurities and obtain an asphaltene free Purified CLO fraction stream which in turn is admixed with separated streams from CLO and PFO and subjected to thermal cracking to produce crystalline coke.

Further, the process as disclosed herein also produces aromatic chemicals from residual streams such as CLO and PFO. The lower boiling aromatics in residue feed stock (PFO) as well as the Gasoil product from thermal cracking of tailor-made admixture obtained from PFO and CLO is selectively converted into high value aromatic chemical rich stream.

Accordingly, the process as disclosed herein provides an integrated scheme to produce crystalline coke along with aromatic chemicals.

SUMMARY

The present invention discloses a process for production of Needle coke and C7-C9 aromatic hydrocarbons from Pyrolytic Fuel Oil (PFO) and Clarified Light Oil (CLO) feedstock. The said process includes steps of routing a Clarified Light Oil (CLO) stream (1) through a CLO Separator Column (2) to obtain a first stream (3) having boiling range below 350° C., a second stream (4) having boiling range between 350-500° C. and a third stream (5) having boiling range above 500° C., wherein, the third stream (5) is mixed with a fresh solvent stream (6) and a recycled solvent stream (13) and routed to a mixer (7) to obtain a mixed stream (8).

The CLO Separator Column (2) is operated at a temperature range of 150-395° C. and an operating Pressure in the range of 0.0001-3 $Kg/cm^2$. The third stream (5) is enriched in asphaltenes and ash, wherein the third stream (5) is routed to the Asphaltene separator unit (9), wherein the Asphaltene separator unit (9) is operated at a temperature range of 25-175° C. The fresh solvent stream (6) includes paraffinic solvents with carbon number ranging from 3 to 7.

Then, routing the mixed stream (8) through a CLO Purification Section comprising of an Asphaltene separator unit (9) from which a solvent rich stream (10) and a Heavy Residue stream (14) are obtained, wherein the solvent rich stream (10) is routed to a Recovery Column (11) to obtain the recycle solvent stream (13) and a Purified CLO fraction stream (12).

Further, the process includes, routing a Pyrolytic Fuel Oil (PFO) stream (29) through a PFO Separator Column (30) to obtain a fourth stream (31) having boiling range below 350° C. and a fifth stream (32) having boiling range above 350° C., wherein the fifth stream (32) is mixed with the second stream (4) and the Purified CLO fraction stream (12) to produce a first mixed stream. The PFO Separator Column (30) is operated at a temperature range of 150-395° C. and an operating Pressure in the range of 0.0001-3 $Kg/cm^2$.

Then, routing the first mixed stream through a main fractionator (15) to produce a Secondary feed stream (19) containing recycle, the Secondary feed stream (19) is heated to thermal cracking temperature inside a first furnace (20) to produce a heated stream (21). Then routing the heated stream (21) to a first reactor (24), or a second reactor (25) to produce a green coke and a cracked effluent vapor stream (28) by thermal cracking and routing stream (28) to the main fractionator (15) for separation into gases and naphtha (16), Light Gasoil (17) and Heavy Gasoil (18), Green Coke is calcined to produce calcined coke.

The green coke is calcined at temperature in the range of 1300° C.-1500° C. to produce crystalline coke. The coke produced is a Needle coke having low ash content in the range of 0.01 to 0.3 wt. % and the Heavy Naphtha (44) produced is enrich in C7-C9 aromatics in the range of 50-60 wt. %.

The first reactor (24), or the second reactor (25) is used in a cycle one after the other, wherein, heavy hydrocarbon molecules crack into lighter hydrocarbons while poly-condensation reactions occur resulting into coke formation.

The Reactors (24, 25) are operated at a temperature range of 470-520° C., Pressure 2-10 Kg/cm$^2$, and 12-48 hours of residence time.

Further, the process includes mixing the Light Gasoil (17) with the fourth stream (31) along with a make-up hydrogen (39) and a recycle hydrogen (38) to produce a second mixed stream, routing the second mixed stream through a second furnace (33) for heating and to produce an effluent stream (34). Then selective hydrocracking of the effluent stream (34) in a fixed bed reactor (35) to produce a reactor effluent stream (36). The selective hydrocracking of the effluent stream (34) is carried out in the fixed bed reactor (35) operated at the temperature range of 350-450° C. and a pressure of 50-150 bar (g).

The reactor effluent stream (36) is sent to a separator (37) to separate Hydrogen from separator effluent (40). The said Hydrogen is used as the recycle hydrogen (38) and the separator effluent (40) is routed to a fractionator (41) for separation into gases (42), Light Naphtha (43), Heavy Naphtha (44) enriched in C7-C9 aromatics and Diesel oil (45).

The fixed bed reactor is configured in a one single unit, or in a series of units, wherein, the fixed bed reactor selectively hydrocracks two and three ring aromatics into single ring aromatics from fourth stream (31) derived from PFO stream (29) and Light Gasoil stream (17) obtained from thermal cracking of admixture of stream (32), stream (4) and Purified CLO fraction stream (12).

The fixed bed reactor comprises a Mild Hydrocracking catalyst having a Silica-alumina or Zeolite support impregnated with active metals selected from Nickel, Cobalt, Molybdenum or a combination thereof.

Objective

It is the primary objective of the present disclosure to provide an integrated process for production of improved quality Needle Coke and aromatic chemicals from Pyrolytic Fuel Oil (PFO) and Clarified Oil (CLO) streams.

It is further objective of the present disclosure to provide a process for production of high-quality Needle coke with a lower ash content by separating and admixing of suitable fractions from PFO and CLO streams along with Purified CLO fraction stream obtained from heavier boiling fraction (500° C.+) of CLO after solvent separation of refractory asphaltene compounds and subjecting the admixture of PFO fraction boiling above 350° C., 350-500° C. boiling range fraction of CLO and Purified CLO fraction produced thereof to thermal cracking.

It is further objective of the present disclosure to produce aromatic chemicals from low boiling fractions separated from PFO.

It is further objective of the present disclosure to produce aromatic chemicals by selective hydrocracking of Light Gasoil Oil (LGO: 140-370° C. boiling range fraction) obtained from the thermal cracking of admixture of fractions of CLO, PFO and Purified CLO fraction.

BRIEF DESCRIPTION OF THE DRAWING

To further clarify advantages and aspects of the disclosure, a more particular description of the present disclosed process will be rendered by reference to specific embodiments thereof, which is illustrated in the appended drawing(s) and explained hereinafter in the description section. It is appreciated that the drawing(s) as provided herein depicts only typical embodiments of the process and are therefore not to be considered limiting of its scope.

FIG. 1: illustrates a schematic flow diagram of the process as disclosed in the present disclosure.

DESCRIPTION

Needle Coke is a high value coke product obtained from Thermal cracking process such as Delayed Coking. Its quality is dependent on parameters such as ash content and high ash content, presence of refractory asphaltene compounds in feed stock etc. deteriorates the quality of Needle coke making it unsuitable for producing graphite electrodes. This ash content is primarily owed to the carried over inorganic impurity content of feed stocks such as catalyst fines which concentrate in coke product. Also, there is an increasing requirement of production of aromatic chemicals from petroleum refineries. Current invention describes an integrated process through which high value Needle coke and Aromatics can be produced simultaneously by utilizing residual feed stock such as CLO and PFO.

According to the main embodiment, the present disclosure provides a process for production of improved quality Needle coke or crystalline coke as well as value added chemicals from hydrocarbon feedstock.

Specifically, the present disclosure provides a process for production of crystalline coke and C7-C9 aromatic hydrocarbons from Pyrolytic Fuel Oil (PFO) and Clarified Light Oil (CLO) feedstocks, wherein the process includes following steps.

Routing a Clarified Light Oil (CLO) stream (1) through a CLO Separator Column (2) to obtain a first stream (3) having boiling range below 350° C., a second stream (4) having boiling range between 350-500° C. and a third stream (5) having boiling range above 500° C., wherein, the CLO Separator Column (2) is operated at a temperature range of 150-395° C. and Pressure in the range of 0.0001-3 Kg/cm$^2$ wherein, the first stream (3) is free from asphaltenes and ash content, the second stream (4) is free from asphaltenes, and the third stream (5) is enriched in asphaltenes and ash content.

Thereafter, the third CLO derived stream (5) is mixed with a fresh solvent stream (6) and a recycled solvent stream (13) and routed to a mixer (7) to obtain a mixed stream (8). Wherein, the fresh solvent stream (6) comprises of paraffinic solvents with carbon number ranging from 3 to 7.

Thereafter, routing the mixed stream (8) through an Asphaltene separator (9) from which a solvent rich stream (10) and a Heavy Residue stream (14) are obtained. Wherein, the Asphaltene separator (9) having temperature in the range of 25-175° C. Thereafter, the solvent rich stream (10) is routed to a Recovery column (11) to obtain the recycle solvent stream (13) and Purified CLO fraction stream (12). Wherein, the Recovery column (11) having temperature in the range of 20-120° C. and Pressure in the range of 1-100 Kg/cm$^2$.

Simultaneously routing a Pyrolytic Fuel Oil (PFO) stream (29) through a PFO Separator Column (30) to obtain a fourth stream (31) having boiling range below 350° C. and a fifth stream (32) having boiling range above 350° C. Wherein, the PFO Separator Column (30) is operated at a temperature range of 150-395° C. and Pressure in the range of 0.0001-3 Kg/cm$^2$. Thereafter, the fifth stream (32) is mixed with the second stream (4) and the Purified CLO fraction stream (12) to produce a first mixed stream.

Routing the mixed stream through a main fractionator (15) to obtain a Secondary feed stream (19) containing internal recycle. The Secondary feed stream (19) is heated to thermal cracking temperature inside a first furnace (20) to produce a heated stream (21). Wherein, the first furnace has a coil outlet temperature in the range of 470-520° C.

Thereafter, routing the heated stream (21) to a first reactor (24), or a second reactor (25) wherein it is provided sufficient residence time to produce green coke and a cracked effluent vapor stream (28) and the green coke is removed from the reactor and calcined to produce the crystalline coke. The cracked effluent vapor stream (28) is routed back to the main fractionator (15) to be separated into gases and naphtha (16), Light Gasoil (17) and heavy gas oil (18).

Further, the overhead temperature of the first reactor (24) or the second reactor (25) is maintained in the range of 430-460° C., the operating pressure is maintained in the range of 2-10 Kg/cm$^2$, and the hydrocarbon residence time is in the range of 12 to 48 hrs. Wherein, the first reactor (24), or the second reactor (25) are used in a cycle one after the other, wherein, heavy hydrocarbon molecules crack into lighter hydrocarbons while poly-condensation reactions occur resulting into coke formation.

Thereafter, mixing the Light Gasoil (17) with the fourth stream (31) along with make-up hydrogen (39) and recycle hydrogen (38) to produce a second mixed stream, routing the second mixed stream through a second furnace (33) for heating at a temperature in the range of 350-450° C. and to produce an effluent stream (34). Subjecting the effluent stream (34) to selective hydrocracking in a fixed bed reactor (35) to produce a reactor effluent stream (36), wherein the reactor effluent stream (36) is sent to a separator (37) to separate Hydrogen from separator effluent (40), the Hydrogen is used as the recycle hydrogen (38) and the separator effluent (40) is routed to a fractionator (41) for separation into gases (42), Light Naphtha (43), Heavy Naphtha (44) enriched in C7-C9 aromatics and Diesel oil (45).

Further, the selective hydrocracking is carried out in the fixed bed reactor operated at the temperature range of 350-450° C. and pressure of 50-150 bar (g).

Further, the fixed bed reactor is configured in a one single unit, or in a series of units, wherein, the fixed bed reactor selectively hydrocracks two and three ring aromatics into single ring aromatics.

Further, the fixed bed reactor comprises a Mild Hydrocracking catalyst having a Silica-alumina or Zeolite support impregnated with active metals selected from Nickel, Cobalt, Molybdenum or a combination thereof.

Further, the coke produced from coke drums are subjected to high temperature calcination at temperature in the range of 1300-1500° C.

Feedstock: The liquid hydrocarbon feed stock which can be used in the process as disclosed herein are selected from different aromatic tars, ethylene tar, Clarified Oils, or Pyrolytic Fuel oil etc.

Solvent: Further, paraffinic solvents can be selected with carbon number ranging from 3 to 7 which are employed for the CLO Purification section.

Process Conditions

Thermal Cracker Unit

In the first furnace, the furnace coil outlet temperature to be maintained is in the range of 470-520° C. Coking reactor overhead temperature may be maintained around 430-460° C. Operating pressure may be maintained in the range of 2-10 Kg/cm$^2$ (g). Hydrocarbon residence time in the reactors is kept in the range of 12 to 48 hrs.

Selective Hydrocracking Unit

Hydrocracking occurs in a reactor or series of reactors operated at the temperature range of 350-450° C. and pressure of 50-150 bar (g).

CLO Purification Section

The CLO Purification Section is operated with paraffinic solvents having Carbon number ranging from C3 to C7 to separate the asphaltene enriched Heavy Residue fraction from the CLO fraction having boiling range above 500° C. This unit is operated at a temperature range of 25-175° C. with a Solvent to Oil ratio ranging from 1:1 to 4:1 (wt/wt). The Purification section separates the ash rich asphaltene fraction as Heavy Residue which deteriorates the Needle coke quality.

CLO Separator and PFO Separator

CLO feedstock is routed to a CLO Separator Column which is operated at a temperature range of 150-395° C. and Pressure in the range of 0.0001-3 Kg/cm$^2$ ensuring that the heavier molecules in CLO fraction having boiling range above 500° C. are not subjected to thermal cracking during separation and separated into fraction boiling below 350° C., fraction boiling in the range of 350° C.-500° C. and fraction boiling above 500° C. PFO feedstock is routed to a PFO Separator Column which is operated at a temperature range of 150-395° C. and Pressure in the range of 0.0001-3 Kg/cm$^2$ ensuring that the heavier molecules in PFO feed stock are not subjected to thermal cracking during separation and separated into fraction boiling below 350° C. and a fraction boiling above 350° C.

Further, the process as disclosed herein is exemplified but not limited to the FIG. 1. In the said process, Clarified Light Oil stream (1) is routed to a CLO Separator Column (2) to obtain fraction boiling below 350° C. (3), fraction in the boiling range 350-500° C. (4) and fraction boiling above 500° C. (5) streams. Stream having boiling range above 500° C. (5) is thereafter mixed with fresh solvent stream (6) and recycled solvent stream (13) and routed to a mixer (7). Stream from mixer which is herein referred as mixed stream (8) is thereafter routed to an Asphaltene separator (9) of CLO Purification Unit from which solvent rich stream (10) and Heavy Residue stream (14) are obtained.

Solvent rich stream (10) is routed to a Recovery column (11). In the Recovery column (11), solvent stream (13) is separated from the Purified CLO fraction stream (12) and recycled back to inlet of the mixer (7). Simultaneously, Pyrolytic Fuel oil stream (29) is sent to a PFO Separator Column (30) where it is separated into fraction boiling below 350° C. (31) and fraction boiling above 350° C. (32) which mixes with 350-500° C. stream (4) and Purified CLO fraction stream (12). This mixed stream is thereafter routed to the Main fractionator (15). Secondary feed stream (19) containing recycle from the bottom section of Main fractionator (15) is heated to thermal cracking temperature inside the furnace (20). Heated stream (21) from furnace outlet is routed to either of the reactors (24) or (25) through (22) or (23) depending on whichever is under filling cycle. Inside the reactors, heavy hydrocarbon molecules crack into lighter hydrocarbons while poly-condensation reactions occur resulting into coke formation. Cracked effluent vapor stream (28) is thereafter routed to the Main fractionator (15) for separation into gases and naphtha (16), Light gas oil (17) and heavy gas oil (18). Green Coke formed inside the reactors is removed and calcined to produce Crystalline Coke. Light Gasoil stream (17) from Main fractionator (15) is mixed with the fraction of PFO boiling below 350° C. (31) along with make-up hydrogen (39) and recycle hydrogen (38) and routed to a furnace (33) for heating.

Thereafter the furnace effluent stream (34) is subjected to selective hydrocracking in a fixed bed reactor (35). Inside the reactor, two and three ring aromatics are selectively hydrocracked into single ring aromatics. Reactor effluent stream (36) rich in C7-C9 aromatics and $H_2$ is sent to a separator (37) in which Hydrogen is separated to generate recycle hydrogen stream (38) and separator effluent (40) is routed to a fractionator (41) for separation into gases (42), Light Naphtha (43), Heavy Naphtha (44) enriched in C7-C9 aromatics and Diesel oil (45).

The examples as provided herein below provides various advantages and disclose the present process in detail.

Example 1: CLO stream having ash content of 0.3 wt % was fractionated into 3 different boiling range fractions as provided in Table-1. It can be observed from Table-2, that ash rich asphaltene fraction is concentrated in Cut no. 3 while Cut no. 2 has lower ash content than full range CLO due to concentration of the same in 500° C.+ boiling range fraction. Thereafter, cut no. 3 was subjected to thermal cracking in a laboratory scale thermal cracker unit as per conditions provided in Table-3 to obtain Green Needle Coke (GNC A). Subsequently, GNC A was subjected to calcination to generate Calcined Needle Coke (CNC A). Property of CNC A is provided in Table-4. It can be observed that CNC A has a lower crystallinity and very high ash content which is not meeting Needle coke specification. Ash content in Needle coke should be preferably less than 0.3 wt %.

TABLE 1

Different boiling range fractions of CLO

| S. No. | Cut | Boiling range |
|---|---|---|
| 1. | Cut no. 1 | 350° C.– |
| 2. | Cut no. 2 | 350° C.-500° C. |
| 3. | Cut no. 3 | 500° C.+ |

TABLE 2

Property comparison of CLO, Cuts 1, 2 and 3

| S.N. | Parameter | CLO (Whole) | 350° C.– 24 wt. % | 350° C.-500° C. 68 wt. % | 500° C.+ 8 wt. % |
|---|---|---|---|---|---|
| 1. | Density, gm/cc | 1.1578 | <1.0725 | 1.0725 | >1.1639 |
| 2. | Saturates, wt % | 6.7 | 16.5 | 3.8 | — |
| 3. | Aromatics + Resins, wt. % | 92.2 | 83.5 | 96.2 | 86 |
| 4. | Asphaltenes, wt % | 1.1 | — | — | 14 |
| 5. | Ash, wt % | 0.25 | — | 0.07 | 2.5 |
| 6. | Distillation, wt. % vs ° C. 5/70/90 | 219/422/658 | 264/343/357 | 350/440/495 | 499/593/656 |

TABLE 3

Operating conditions for thermal cracking experiment as described in Example 1

| S. No. | Parameter | Value |
|---|---|---|
| 1. | Feed weight, gm | 100 |
| 2. | Operating temperature, ° C. | 475 |
| 3. | Pressure, $Kg/cm^2$ (g) | 7 |
| 4. | Residence time, hrs | 4 |

TABLE 4

Crystallinity and ash content of CNC A

| S. No. | Parameter | CNC A |
|---|---|---|
| 1. | Crystallinity, % | 37.2 |
| 2. | Crystallite size, A° | 35 |
| 3. | Ash, wt % | 3 |

Example 2: In Experiment no. 2, 500° C.+ boiling range fraction (Cut no. 3) was treated with n-heptane in the ratio 1:4 (wt/wt) at a temperature of 60° C. to obtain Heavy Residue and Purified CLO fractions. Property comparison of Purified CLO fraction and Heavy Residue is provided as Table-5. It can be observed that the asphaltenes have concentrated in Heavy Residue in comparison to Purified CLO fraction. Also, ash present in 500° C.+ fraction is getting concentrated in the heavy residue fraction and a Purified CLO fraction free from ash is obtained.

TABLE 5

Property of Purified CLO fraction and Heavy Residue

| S. No. | Parameter | Purified CLO fraction | Heavy Residue from 500° C.+ |
|---|---|---|---|
| 1. | Aromatics, wt % | 40 | — |
| 2. | Resins, wt % | 60 | 36 |
| 3. | Asphaltenes, wt % | — | 64 |
| 4. | Ash, wt % | — | 17 |

Example 3: In Experiment no. 3, 350-500° C. fraction (Cut no. 2) obtained from CLO was mixed with whole Pyrolytic fuel oil (PFO) having property provided in Table-6 and subjected to thermal cracking experiment as per operating conditions provided in Table-7 to obtain Green Needle Coke (GNC-B). Coke so obtained from thermal cracking experiment was calcined at 1300° C. to generate CNC-B. Property of CNC-B is provided in Table-8. It can be observed that crystallinity and ash content of coke obtained from processing an admixture of Cut no. 2 and PFO is better than that of coke obtained from processing of Cut no. 3 as described in Example 1. Also, Coke yield in case of processing an admixture of PFO and Cut no. 2 is higher in comparison to processing 100% PFO as mentioned in Table-7 & 10. It can be observed from Table-7, 8, 10 & 11 that Needle coke with superior crystallinity and lower ash content could be produced in larger quantity by processing the admixture of PFO and Cut no. 2 in comparison to that produced from thermal cracking of whole PFO.

TABLE 6

Property of PFO

| S. No. | Parameter | Value |
|---|---|---|
| 1. | Density, gm/cc | 1.0378 |
| 2. | Aromatics + Resins, wt. % | 100 |
| 3. | Ash, wt. % | <0.1 |
| 4. | Distillation, wt. % vs ° C. 5/70/90 | 188/327/501 |

TABLE 7

Operating conditions and Coke yield from Experiment no. 3

| S. No. | Parameter | Value |
|---|---|---|
| 1. | Feed weight, gm | 100 |
| 2. | Feed composition (wt %), PFO:Cut no. 2 | 20:80 |
| 3. | Operating temperature, ° C. | 475 |
| 4. | Pressure, $Kg/cm^2$ (g) | 7 |
| 5. | Residence time, hrs | 4 |
| 6. | Coke yield, wt % | 32 |

TABLE 8

Property of CNC B

| S. No. | Parameter | Value |
|---|---|---|
| 1. | Crystallinity, % | 60 |
| 2. | Crystallite size, A° | 39 |
| 3. | Ash content, wt % | 0.2 |

PFO feed stock was subjected to fractionation and separated into following cut points as provided in Table-9:

TABLE 9

Different boiling ranges of PFO

| S. No. | Cut | Boiling range |
|---|---|---|
| 1. | Cut no. 4 | 350° C.– |
| 2. | Cut no. 5 | 350° C.+ |

Example 4: In Experiment no. 4, whole PFO feed stock was subjected to thermal cracking in laboratory scale thermal cracker unit as per conditions indicated in Table-10. Coke generated thereof (GNC C) was subjected to calcination (CNC C) at 1300° C. and analyzed for crystallinity and ash content. Crystallinity and ash content of coke are provided in Table-11.

TABLE 10

Operating conditions and Coke yield from Experiment no. 4

| S. No. | Parameter | Value |
|---|---|---|
| 1. | Feed weight, gm | 100 |
| 2. | Feed composition (wt %), PFO | 100 |

TABLE 10-continued

Operating conditions and Coke yield from Experiment no. 4

| S. No. | Parameter | Value |
|---|---|---|
| 3. | Operating temperature, ° C. | 475 |
| 4. | Pressure, $Kg/cm^2$ (g) | 7 |
| 5. | Residence time, hrs | 4 |
| 6. | Coke yield, wt % | 20 |

TABLE 11

Property of CNC C

| S. No. | Parameter | Value |
|---|---|---|
| 1. | Crystallinity, % | 32.3 |
| 2. | Crystallite size, A° | 36 |
| 3. | Ash, wt. % | 0.16 |

Example 5: In Experiment no. 5, Cut no. 5 was mixed with Cut no. 2 as per conditions provided in Table-12. Coke generated thereof (GNC D) was subjected to calcination (CNC D) and analyzed for crystallinity and ash content which are provided in Table-13.

TABLE 12

Operating conditions & Coke yield from Experiment no. 5

| S. No. | Parameter | Value |
|---|---|---|
| 1. | Feed weight, gm | 100 |
| 2. | Feed composition (wt. %), Cut no. 5:Cut no. 2 | 30:70 |
| 3. | Operating temperature, ° C. | 475 |
| 4. | Pressure, $Kg/cm^2$ (g) | 7 |
| 5. | Residence time, hrs | 4 |
| 6. | Coke yield, wt. % | 37 |

TABLE 13

Property of CNC D

| S. No. | Parameter | Value |
|---|---|---|
| 1. | Crystallinity, % | 47 |
| 2. | Ash content, wt % | 0.24 |

Example 6: In Experiment no. 6, Cut nos. 2 and 5 were mixed with Purified CLO fraction as obtained in Example 2 as per conditions provided in Table-14. Coke generated thereof (GNC E) was subjected to calcination (CNC E) and analyzed for crystallinity and ash content which are provided in Table-15.

TABLE 14

Operating conditions & Coke yield from Experiment no. 6

| S. No. | Parameter | Value |
|---|---|---|
| 1. | Feed weight, gm | 100 |
| 2. | Cut no. 5:Cut no. 2: Purified CLO Fraction | 26:67:7 |
| 2. | Operating temperature, ° C. | 475 |
| 3. | Pressure, $Kg/cm^2$ (g) | 7 |
| 4. | Residence time, hrs | 4 |
| 5. | Coke yield, wt % | 35.1 |

TABLE 15

| Property of CNC E | | |
|---|---|---|
| S. No. | Parameter | Value |
| 1. | Crystallinity, % | 60.4 |
| 2. | Crystallite size, A° | 39.5 |
| 3. | Ash content, wt % | 0.24 |

Example 7: In Experiment no. 7, Cut no. 4 was subjected to selective hydrocracking in a series of reactors R-1 and R-2 using Ni—Mo catalyst over Zeolite support. R-1 was operated at Weighted Average Bed Temperature (WABT) of 360° C. while R-2 was operated at WABT of 375° C. Both the reactors were operated at 55 bar (g) pressure and Liquid Hourly Space Velocity (LHSV) was maintained at 1.5 $hr^{-1}$ in both the reactors. Product was collected from a separator and analyzed. Product yield obtained is provided in Table-16.

TABLE 16

| Product Yield of Hydrocracking Experiment no. 7 | | |
|---|---|---|
| S. No. | Component | Yield, wt. % |
| 1. | Off-gas | 1.49 |
| 2. | LPG | 4.06 |
| 3. | Light Naphtha (LN) | 25.93 |
| 4. | Heavy Naphtha (HN) | 53.85 |
| 5. | Unconverted Oil/Diesel | 14.67 |
| 6. | C7-C9 aromatics in HN, wt. % | 55 |
| 7. | Total C7-C9 aromatics, wt. % | 30 |

Example 8: In Experiment no. 8, Cut no. 2 was mixed Cut no. 5 and Purified CLO fraction and processed in a lab scale thermal cracker unit (67:26:7) at a pressure of 7 $Kg/cm^2$ (g) and a temperature of 475° C. The product yield obtained is provided in Table-17. Thereafter, the product was subjected to batch scale distillation to generate 140-370° C. boiling range fraction which is also referred to as Light Gasoil (LGO). Thereafter, LGO and Cut no. 4 were mixed in a ratio 27:73 respectively to prepare feed for Hydrocracking experiment. This mixed feed was processed in a series of reactors R-1 followed by R-2. WABT of R-1 was maintained at 360° C. while that of R-2 was maintained at 380° C. Both the reactors were operated at a pressure of 52 bar (g) and LHSV of 2 $hr^{-1}$. Product was collected from a separator and analyzed. Product yield is provided in Table-18.

TABLE 17

| Product yield of Thermal cracking experiment as described in Example 8 | | |
|---|---|---|
| S. No. | Component | Yield, wt % |
| 1. | Off-gas | 5.7 |
| 2. | LPG | 2.2 |
| 3. | Naphtha (C5-140) | 4.5 |
| 4. | LGO (140-370) | 27 |
| 5. | HGO (370+) | 24.4 |
| 6. | Coke | 36.2 |

TABLE 18

| Product Yield of Hydrocracking Experiment as described in Example 8 | | |
|---|---|---|
| S. No. | Component | Yield, wt % |
| 1. | Off-gas | 1.39 |
| 2. | LPG | 5.68 |
| 3. | Light Naphtha (LN) | 25.74 |
| 4. | Heavy Naphtha (HN) | 54.11 |
| 5. | Unconverted Oil/Diesel | 13.08 |
| 6. | C7-C9 aromatics in HN, wt % | 55 |
| 7. | Total C7-C9 aromatics, wt % | 30 |

Example 9: In Experiment no. 9, CLO was subjected to fractionation into Cut nos. 1 at a flask temperature of 180° C. and Pressure of 2 mm Hg (0.003 $Kg/cm^2$), Cut nos. 2 and 3 at a temperature of 290° C. and a Pressure of 0.5 mm Hg (0.0007 $Kg/cm^2$) while PFO was subjected to fractionation into Cut nos. 4 and 5 at a flask temperature of 185° C. and Pressure of 1 mm Hg (0.001 $Kg/cm^2$). Thereafter, Cut no. 3 of CLO was mixed with n-heptane in a mixer in Solvent to Feed ratio of 1:4 and subjected to Purification to obtain Heavy Residue and Purified CLO fraction which is mixed with Cut nos. 2 and 5 (Cut no. 2: Cut no. 5: Purified CLO Fraction: 67:26:7 wt/wt). This mixed stream was subjected to thermal cracking at a pressure of 7 $Kg/cm^2$ (g) and a temperature of 475° C. to obtain Coke and distillates. Cut no. 4 after mixing with LGO stream (140-370° C. boiling range) of distillates was subjected to mild hydrocracking to obtain C7-C9 aromatic containing stream. Combined Yield of the products from the process configuration is provided in Table-19.

TABLE 19

| Combined Yield from the process as described in Example 9 | |
|---|---|
| Product | Yield, wt % |
| Coke | 18 |
| C7-C9 aromatics | 15 |
| Total Coke + Aromatics | 33 |
| Gases | 8 |
| Naphtha | 27 |
| Diesel | 31 |
| Heavy Residue | 1 |
| Total | 100 |

Example 10: In Experiment no. 10, Cut no. 2 was mixed Cut no. 5 and Purified CLO fraction and processed in a lab scale thermal cracker unit (67:26:7) at a pressure of 9 $Kg/cm^2$ (g) and a temperature of 475° C. The product yield obtained is provided in Table-20. Thereafter, the product was subjected to batch scale distillation to generate 140-370° C. boiling range fraction which is also referred to as Light Gasoil (LGO). Thereafter, LGO and Cut no. 4 were mixed in a ratio 23:77 respectively to prepare feed for Hydrocracking experiment. This mixed feed was processed in a series of reactors R-1 followed by R-2. WABT of R-1 was maintained at 380° C. while that of R-2 was maintained at 390° C. Both the reactors were operated at a pressure of 52 bar (g) and LHSV of 2 $hr^{-1}$. Product was collected from a separator and analyzed. Combined yield from the process is provided in Table-20.

TABLE 20

| Combined Yield from the process as described in Example 10 | |
|---|---|
| Product | Yield, wt % |
| Coke | 25 |
| C7-C9 aromatics | 14 |
| Total Coke + Aromatics | 39 |
| Gases | 9 |
| Naphtha | 26 |
| Diesel | 25 |
| Heavy Residue | 1 |
| Total | 100 |

Example 11: In Experiment no. 11, Cut no. 2 (350-500° C.) of CLO was subjected to thermal cracking as per conditions provided in Table-21. Coke (GNC-F) from the experiment was subjected to calcination at 1300° C. to obtain CNC-F. Property of CNC-F is provided in Table-22.

TABLE 21

| Operating conditions & Coke yield from Experiment no. 11 | | |
|---|---|---|
| S. No. | Parameter | Value |
| 1. | Feed weight, gm | 100 |
| 2. | Feed composition (wt %), Cut no. 2 | 100 |
| 2. | Operating temperature, ° C. | 475 |
| 3. | Pressure, Kg/cm$^2$ (g) | 7 |
| 4. | Residence time, hrs | 4 |
| 5. | Coke yield, wt % | 35 |

TABLE 22

| Property of CNC E | | |
|---|---|---|
| S. No. | Parameter | Value |
| 1. | Crystallinity, % | 54 |
| 2. | Crystallite size, A° | 37.9 |
| 3. | Ash content, wt % | 0.23 |

Example 12: In Experiment no. 12, whole CLO was subjected to thermal cracking as per conditions provided in Table-23. Coke (GNC-G) from the experiment was subjected to calcination at 1300° C. to obtain CNC-G. Property of CNC-G is provided in Table-24.

TABLE 23

| Operating conditions & Coke yield from Experiment no. 12 | | |
|---|---|---|
| S. No. | Parameter | Value |
| 1. | Feed weight, gm | 100 |
| 2. | Feed composition (wt. %), Whole CLO | 100 |
| 2. | Operating temperature, ° C. | 475 |
| 3. | Pressure, Kg/cm$^2$ (g) | 7 |
| 4. | Residence time, hrs | 4 |
| 5. | Coke yield, wt % | 30 |

TABLE 24

| Property of CNC G | | |
|---|---|---|
| S. No. | Parameter | Value |
| 1. | Crystallinity, % | 38.2 |
| 2. | Crystallite size, A° | 38.4 |
| 3. | Ash content, wt % | 0.8 |

We claim:

1. A process for production of Needle coke and C7-C9 aromatic hydrocarbons from Pyrolytic Fuel Oil (PFO) and Clarified Light Oil (CLO) feedstock, wherein the process comprises steps of:

routing a Clarified Light Oil (CLO) stream (1) through a CLO Separator Column (2) to obtain a first stream (3) having boiling range below 350° C., a second stream (4) having boiling range between 350-500° C. and a third stream (5) having boiling range above 500° C., wherein, the third stream (5) is mixed with a fresh solvent stream (6) and a recycled solvent stream (13) and routed to a mixer (7) to obtain a mixed stream (8);

routing the mixed stream (8) through a CLO Purification Section comprising of an Asphaltene separator unit (9) from which a solvent rich stream (10) and a Heavy Residue stream (14) are obtained, wherein the solvent rich stream (10) is routed to a Recovery Column (11) to obtain the recycle solvent stream (13) and a Purified CLO fraction stream (12);

routing a Pyrolytic Fuel Oil (PFO) stream (29) through a PFO Separator Column (30) to obtain a fourth stream (31) having boiling range below 350° C. and a fifth stream (32) having boiling range above 350° C., wherein the fifth stream (32) is mixed with the second stream (4) and the Purified CLO fraction stream (12) to produce a first mixed stream;

routing the first mixed stream through a main fractionator (15) to produce a Secondary feed stream (19) containing recycle, the Secondary feed stream (19) is heated to thermal cracking temperature inside a first furnace (20) to produce a heated stream (21);

routing the heated stream (21) to a first reactor (24), or a second reactor (25) to produce a green coke and a cracked effluent vapor stream (28) by thermal cracking and routing stream (28) to the main fractionator (15) for separation into gases and naphtha (16), Light Gasoil (17) and Heavy Gasoil (18), Green Coke is calcined to produce calcined Needle coke;

mixing the Light Gasoil (17) with the fourth stream (31) along with a make-up hydrogen (39) and a recycle hydrogen (38) to produce a second mixed stream, routing the second mixed stream through a second furnace (33) for heating and to produce an effluent stream (34); and selectively hydrocracking the effluent stream (34) in a fixed bed reactor (35) to produce a reactor effluent stream (36), wherein the reactor effluent stream (36) is sent to a separator (37) to obtain a separator effluent (40) and hydrogen, wherein the hydrogen is used as the recycle hydrogen (38) and the separator effluent (40) is routed to a fractionator (41) for separation into gases (42), Light Naphtha (43), Heavy Naphtha (44) enriched in C7-C9 aromatics and Diesel oil (45).

2. The process as claimed in claim 1, wherein the CLO stream (1) is routed to the CLO Separator Column (2), wherein the CLO Separator Column (2) is operated at a temperature range of 150-395° C. and an operating Pressure in the range of 0.0001-3 Kg/cm$^2$.

3. The process as claimed in claim 1, wherein the PFO stream (29) is routed to the PFO Separator Column (30), wherein the PFO Separator Column (30) is operated at a temperature range of 150-395° C. and an operating Pressure in the range of 0.0001-3 Kg/cm$^2$.

4. The process as claimed in claim 1, wherein the third stream (5) is enriched in asphaltenes and ash, wherein the third stream (5) is routed to the Asphaltene separator unit (9), wherein the Asphaltene separator unit (9) is operated at a temperature range of 25-175° C.

5. The process as claimed in claim 1, wherein the fresh solvent stream (6) comprises of paraffinic solvents with carbon number ranging from 3 to 7.

6. The process as claimed in claim 1, wherein the reactors (24, 25) are operated at a temperature range of 470-520° C., Pressure 2-10 Kg/cm$^2$, and 12-48 hours of residence time.

7. The process as claimed in claim 1, wherein the green coke is calcined at temperature in the range of 1300° C.-1500° C. to produce crystalline coke.

8. The process as claimed in claim 1, wherein the first reactor (24), or the second reactor (25) is used in a cycle one after the other, wherein, the heavy hydrocarbon molecules crack into lighter hydrocarbons while poly-condensation reactions occur resulting into coke formation.

9. The process as claimed in claim 1, wherein the selective hydrocracking of the effluent stream (34) is carried out in the fixed bed reactor (35) operated at the temperature range of 350-450° C. and a pressure of 50-150 bar (g).

10. The process as claimed in claim 1, wherein the fixed bed reactor is configured in a one single unit, or in a series of units, wherein, the fixed bed reactor selectively hydrocracks two and three ring aromatics into single ring aromatics from fourth stream (31) derived from PFO stream (29) and Light Gasoil stream (17) obtained from thermal cracking of admixture of stream (32), stream (4) and Purified CLO fraction stream (12).

11. The process as claimed in claim 1, wherein the fixed bed reactor comprises a Mild Hydrocracking catalyst having a Silica-alumina or Zeolite support impregnated with active metals selected from Nickel, Cobalt, Molybdenum or a combination thereof.

12. The process as claimed in claim 1, wherein the calcined Needle coke has low ash content in a range of 0.01 to 0.3 wt. % and the Heavy Naphtha (44) produced is enriched in C7-C9 aromatics in a range of 50-60 wt. %.

* * * * *